US005311691A

United States Patent [19]

Cacek

[11] Patent Number: 5,311,691

[45] Date of Patent: May 17, 1994

[54] RIFLE SAFETY INDICATOR

[75] Inventor: Thomas E. Cacek, Lakewood, Calif.

[73] Assignee: Viper Products Company, Inc., Huntington Beach, Calif.

[21] Appl. No.: 42,290

[22] Filed: Mar. 26, 1993

[51] Int. Cl.[5] ..... F41A 35/00; F41A 17/44

[52] U.S. Cl. ..... 42/1.01; 42/70.01

[58] Field of Search ..... 42/70.01, 1.05, 1.01; 89/1.4, 142

[56] References Cited

U.S. PATENT DOCUMENTS

| | | | |
|---|---|---|---|
| 2,313,608 | 3/1943 | Wiles | 42/1.01 |
| 2,997,802 | 8/1961 | Robbins | 42/70.01 |
| 3,570,161 | 3/1971 | Nordhauser | 42/70.01 |
| 4,565,113 | 1/1986 | Bunning | 89/1.4 |
| 4,835,894 | 6/1989 | Libassi | 42/70.11 |

FOREIGN PATENT DOCUMENTS

| | | | |
|---|---|---|---|
| 1453923 | 8/1969 | Fed. Rep. of Germany | 89/1.4 |

*Primary Examiner*—Stephen M. Johnson

*Attorney, Agent, or Firm*—William W. Haefliger

[57] ABSTRACT

An indicator for use on a rifle to indicate from a distance that the bolt of the rifle is open, the rifle having a charging handle and a receiver, and comprising in combination a body having two forwardly extending upright rails which are laterally spaced apart; a forwardly extending base integral with the rails and from which the two rails depend; an indicator flag integral with the base and upstanding therefrom; the rails having forward ends configured for interfit with the receiver, and having rearward ends configured for interfit with the charging handle, whereby the flag projects visibly upwardly relative to charging handle and receiver.

10 Claims, 2 Drawing Sheets

RIFLE SAFETY INDICATOR

BACKGROUND OF THE INVENTION

This invention relates generally to indicators used on rifles to indicate bolt open status, for safety; and more particularly the invention concerns a unique, simple, easily installed indicator fitting between a rifle charging handle and receiver, and incorporating an indicator flag outstanding from the rifle to clearly indicate bolt-open status, the device being easily installed on a rifle and easily and quickly removable from installed position.

In the past, known indicators installable on rifles used in shooting matches, as in the chambers of such rifles did not work well on M-16 rifles, and on civilian versions (the AR-15 rifles), because such a rifle has an ejection port on the right side of the rifle and the flag that protrudes from the indicator is only visible on the right side of the rifle. A range officer looking down the firing line cannot see the indicator in place to his right. There is need for an improved indicator which can be seen, i.e. is visible to range officers looking down the firing line at either end thereof.

SUMMARY OF THE INVENTION

It is a major object of the invention to provide for "safe" indication of the bolts of rifles such as M-16 and AR-15 rifles, by provision of indicator apparatus visible from opposite sides of the rifle, and at a distance, thereby enabling firing officers to determine that all rifles in use on a firing line are "safe". In this regard it is a major object to provide an indicator that locks into place between the charging handle and the rear of the receiver of the rifle. The charging handle is back one-half of its travel to the rear by the open bolt indicator. The charging handle is connected directly to the bolt of the rifle internally so the bolt is also held open. Typically, the charging handle locks into the rear of the receiver by a male-female connection. The open bolt indicator imitates the male-female connection so the indicator is locked into place by the charging handle and receiver; the indicator has a large vertical flag to show it is in place from a distance. Also the vertical flag can be seen from both sides of the rifle.

Accordingly, the invention is embodied in an indicator for use on a rifle to indicate from a distance that the bolt of the rifle is open, the rifle having a charging handle and a receiver, and comprising in combination:

a) a body having two forwardly extending upright rails which are laterally spaced apart, b) a forwardly extending base integral with the rails and from which the two rails depend;

c) an indicator flag integral with the base and upstanding therefrom;

d) the rails having forward ends configured for interfit with the receiver, and having rearward ends configured for interfit with the charging handle, whereby the flag projects visibly upwardly relative to said charging handle and receiver.

As will be seen, the rails typically have rearward ends projecting rearwardly and configured to interfit said charging handle. The rail forward ends are advantageously tapered in like relation; and the rail rearward ends are typically recessed in like forwardly tapered relation.

It is another object to provide the base with a forward terminus spaced rearwardly from the rail forward ends, and with a rearward terminus spaced rearwardly from the rail rearward ends. The flag itself may advantageously comprise a forwardly elongated, upright plate, having a bright color.

These and other objects and advantages of the invention, as well as the details of an illustrative embodiment, will be more fully understood from the following specification and drawings, in which:

DRAWING DESCRIPTION

DETAILED DESCRIPTION

Figure 1:
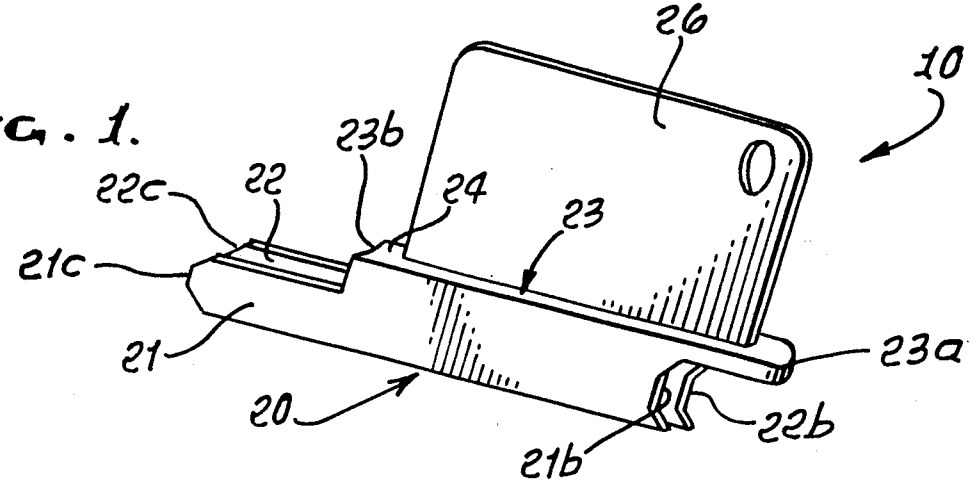
FIG. 1 is a perspective view of an indicator incorporating the invention.
Figure 5:
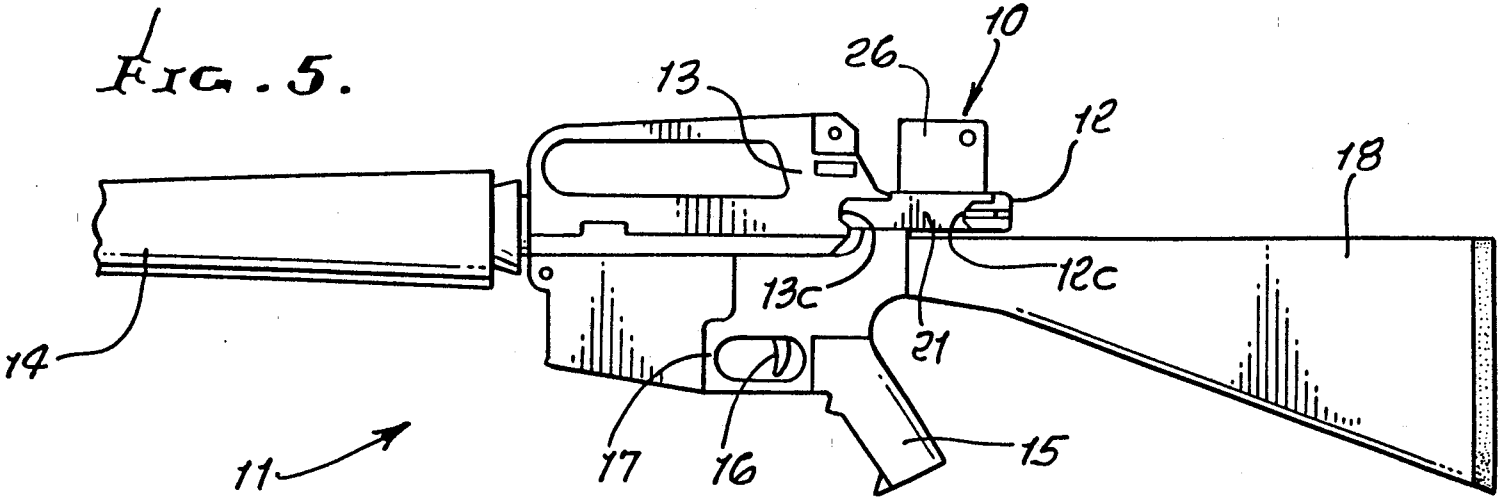
FIG. 5 is a side elevation showing a rifle on which the FIGS. 1–4 indicator is installed.
Figure 2:
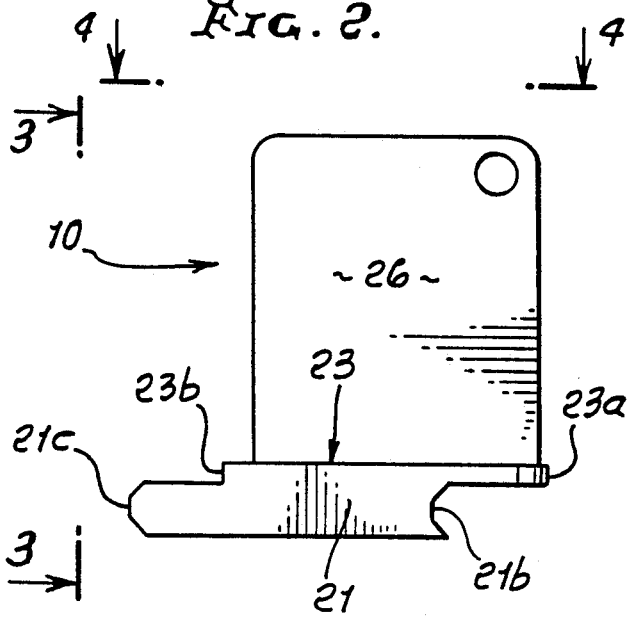
FIG. 2 is a side elevation of the FIG. 1 indicator.

In the drawings, the indicator 10 is constructed for use on a rifle 11, as shown in FIG. 5. The rifle is an M-16, as is known, and has a charging handle 12 and a receiver, 13. Other aspects of the rifle include a barrel housing 14, grip 15, trigger 16, trigger housing 17, and shoulder piece 18. The indicator 10 is adapted to indicate from a distance that the bolt of the rifle is open, i.e. that the rifle is in safe condition as seen from a distance, as in both directions along a firing line.

Figure 3:
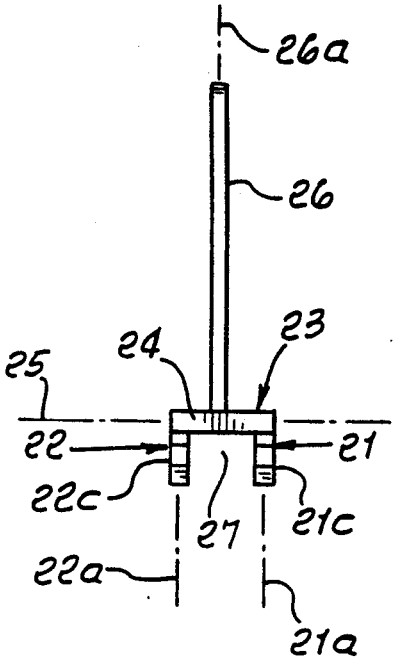
FIG. 3 is an end elevation taken on lines 3—3 of FIG. 2.
Figure 4:
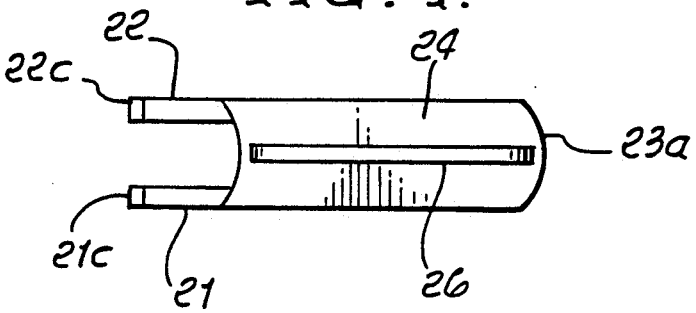
FIG. 4 is op plan view taken on lines 4—4 of FIG. 2.

The indicator has a body 20 with two forwardly generally parallel extending, upright rails 21 and 22 which are laterally spaced apart. A forwardly extending base 23 also extends forwardly and is integral with the rails which depend from the base. The base has inverted channel shape, and has a top plate 24 which extends in a lateral plane 25 generally normal to the upright parallel planes **21*a* and 22*a* defined by the spaced rails. See FIG. 3. The base supports an indicator flag 26 which is upstanding from the base in a plane 26*a* which is parallel to planes 21*a* and 22*a*, and bisects the space 27 between the latter. That flag typically has a bright color to be visible from opposite directions along a firing line. Note in FIG. 5** that the flag stands upright, clear of both opposite sides of the rifle.

It will also be seen that the two rails 21 and 22 have rearward ends **21*b* and 22*b* configured to interfit in wedge relation with the forwardly tapered charging handle 12; and for that purpose those rearward ends are typically recessed in like forwardly tapered relation, spaced forwardly from the rearward end 23*a* of the base 23. Similarly, the two rails have forward ends 21*c* and 22*c* configured to interfit in wedge relation with the rifle receiver 13; and for that purpose the forward ends 21*c* and 22*c* are typically forwardly tapered in like relation, spaced forwardly from the forward end 23*b* of base 23**.

The above relationships will appear clear from inspection of FIG. 5, showing the receiver 13 having a forwardly tapered recess at **13*c*; and the charging handle 12 having a forwardly tapering base 12*c*. Accordingly, the charging handle locks into the rear of the receiver by a male-female connection. The open bolt indicator imitates the male-female connection so the indicator is locked into place by the charging handle and receiver; and the indicator a large vertical flag shows it is in place, from a distance. Note that the flag is always spaced form 12 and 13**, so as not to be damaged, yet is firmly held in place. Also the vertical flag can be seen from both sides of the rifle.

The invention prevents accidental discharge of the M-16/AR-15 type rifles. The chamber of the rifle can also be visually inspected.

In use, the indicator is placed between the charging handle and the rear of the receiver, thus locking the bolt open.

Installation can be accomplished with one hand by holding the indicator by the flag between the first and second fingers with the two prongs facing forward. Next the charging handle is pulled back using the thumb and third fingers. The indicator is positioned over the charging handle shaft, and the charging handle eased forward, locking the indicator between the charging handle and the rear of the receiver.

Unusual advantages include the following:

A. The indicator is highly visible from both sides of the rifle.

B. The rifle is totally safe and cannot be fired with the indicator in place.

C. With the indicator in place, the bolt is held open approximately one-half of its travel. This allows a visual inspection, and/or cleaning with the rifle in a safe condition.

D. Once the indicator is in place, it cannot be knocked out or removed without pulling back the charging handle at least one-half inch.

E. The indicator can be in place while the rifle is stored in either a case, or a rack without interference to other rifles in the rack. Also, the port cover can be closed with the indicator in place to further protect the rifle while in storage.

F. The rifle can be carried slinged from firing line to firing line with the indicator in place.

G. The indicator can be easily installed with one hand while the shooter is still in shooting position.

I claim:

1. An indicator for use on a rifle to indicate from a distance that the bolt of the rifle is open, the rifle having a charging handle and a receiver, and comprising in combination:

a) a body having two forwardly extending upright rails which are laterally spaced apart, b) a forwardly extending base integral with the rails and from which the two rails depend, c) an indicator flag integral with the base and upstanding therefrom, d) the rails having forward ends configured for interfit with the receiver, and having rearward ends configured for interfit with the charging handle, whereby the flag projects visibly upwardly relative to said charging handle and receiver, e) said rearward ends projecting rearwardly and being configured to interfit said charging handle, f) said base having a rearward terminus spaced rearwardly from said rial rearward ends.

2. The combination of claim 1 wherein said rail forward ends are forwardly tapered.

3. The combination of claim 1 wherein said base has a forward terminus spaced rearwardly from said rail forward ends.

4. The combination of claim 1 including said rifle, said rail forward ends having wedging interfit with said rifle receiver.

5. The combination of claim 1 wherein the indicator flag projects upwardly relative to the base and has bright color.

6. An indicator for use on a rifle to indicate from a distance that the bolt of the rifle is open, the rifle having a charging handle and a receiver, and comprising in combination:

a) a body having two forwardly extending upright rails which are laterally spaced apart, b) a forwardly extending base integral with the rails and from which the two rails depend, c) an indicator flag integral with the base and upstanding therefrom, d) the rails having forward ends configured for interfit with the receiver, and having rearward ends configured for interfit with the charging handle, whereby the flag projects visibly upwardly relative to said charging handle and receiver, e) said base having an inverted forwardly elongated channel shape.

7. The combination of claim 6 wherein said rearward ends project rearwardly and are configured to interfit said charging handle.

8. The combination of claim 7 wherein said rail rearward ends are recessed in like forwardly tapered relation.

9. The combination of claim 6 including said rifle, said rail rearward ends having wedging interfit with said rifle charging handle.

10. An indicator for use on a rifle to indicate from a distance that the bolt of the rifle is open, the rifle having a charging handle and a receiver, and comprising in combination:

a) a body having two forwardly extending upright rails which are laterally spaced apart, b) a forwardly extending base integral with the rails and from which the two rails depend, c) an indicator flag integral with the base and upstanding therefrom, d) the rails having forward end configured for interfit with the receiver, and having rearward ends configured for interfit with the charging handle, whereby the flag projects visibly upwardly relative to said charging handle and receiver, e) said flag comprising a forwardly elongated, upright plate.

* * * * *